US005466358A

United States Patent [19]

Kiyomiya et al.

[11] Patent Number: 5,466,358

[45] Date of Patent: Nov. 14, 1995

[54] METHOD OF FORMING A FLUORESECENT SCREEN BY ELECTRODEPOSITION ON A SCREEN PANEL OF A FIELD EMISSION DISPLAY

[75] Inventors: Tadashi Kiyomiya, Saitama; Toshio Ohoshi, Tokyo; Masami Okita, Kanagawa, all of Japan

[73] Assignee: Sony Corporation, Tokyo, Japan

[21] Appl. No.: 290,102

[22] Filed: Aug. 15, 1994

[30] Foreign Application Priority Data

Aug. 18, 1993 [JP] Japan ..... 5-225204

[51] Int. Cl.[6] ..... C25D 13/02; C25D 15/00

[52] U.S. Cl. ..... 205/96; 205/109; 205/122; 205/162; 205/163; 205/171; 205/188; 204/181.1; 204/181.5; 204/181.6; 204/181.7

[58] Field of Search ..... 205/109, 122, 205/162, 163, 170, 171, 188, 96, 228; 204/181.1, 181.4, 181.5, 181.6, 181.7

[56] References Cited

U.S. PATENT DOCUMENTS 3,314,871 4/1967 Heck et al. ..... 204/181.5

5,277,784 1/1994 Woo ..... 205/109

FOREIGN PATENT DOCUMENTS 118363 10/1978 Japan .

*Primary Examiner*—John Niebling
*Assistant Examiner*—Edna Wong
*Attorney, Agent, or Firm*—Hill, Steadman & Simpson

[57] ABSTRACT

A method of forming a fluorescent screen for a field emission display by electrodeposition comprises: forming a transparent solid electrode or transparent stripe or dot electrodes (1) in an effective area and a guard electrode (3, 8) in an ineffective area surrounding the effective area on the inner surface of a screen panel (13), immersing the screen panel (13) in an electrodeposition solution (12G, 12B, 12R, 12M) containing dispersed particles of a fluorescent material and contained in an electrodeposition tank (11), applying a voltage to the transparent solid electrode or the transparent stripe or dot electrodes, and a reverse bias voltage to the guard electrode (3, 8) to deposit particles of the fluorescent material only on the transparent solid electrode or the transparent stripe or dot electrodes to which the voltage is applied. The guard electrode (3, 8) prevents the deposition of particles of the fluorescent material in the ineffective area.

5 Claims, 3 Drawing Sheets

METHOD OF FORMING A FLUORESECENT SCREEN BY ELECTRODEPOSITION ON A SCREEN PANEL OF A FIELD EMISSION DISPLAY

BACKGROUND OF THE INVENTION

The present invention relates to a method of forming a fluorescent screen for a field emission cathode-ray display by an electrodeposition process and, more particularly, to a method of forming a fluorescent screen provided with a uniform fluorescent coating for a field emission cathode-ray display by electrodeposition, capable of preventing the deposition of a fluorescent material in an ineffective area in the surface of the fluorescent screen.

Generally, the fluorescent films of the fluorescent screen of a cathode-ray tube, such as a color cathode-ray tube or a monochromatic cathode-ray tube, are formed principally by a slurry process, and the fluorescent films of the fluorescent screens of some cathode-ray tubes are formed by a printing process or an electrodeposition process. The fluorescent screen of a field effect display is provided with a plurality of pillars arranged in a pattern to secure a vacuum and it is therefore very difficult to form fluorescent films between the plurality of pillars on the screen panel by a slurry process or a printing process. However, fluorescent films can be formed in desired areas corresponding to an electrode pattern on a screen panel by an electrodeposition process even if the screen panel has pillars. A method of forming fluorescent films on a screen panel by an electrodeposition process is proposed in Japanese Patent Application No. 4-225994.

In an electrodeposition process, a screen panel provided with transparent electrodes, and a counter electrode are immersed opposite to each other in an electrodeposition solution prepared by dispersing particles of a fluorescent material in an aqueous or nonaqueous electrolytic solution containing an electrolyte for positively or negatively charging the particles of the fluorescent material, a negative (positive) voltage and a positive (negative) voltage are applied respectively to the the transparent electrodes of the screen panel and the counter electrode when the fluorescent material is positively (negatively) charged to deposit the fluorescent material over the surfaces of the electrodes.

A fluorescent screen fabricating method disclosed in Japanese Patent Publication (Kokoku) No. 60-11415 for forming a color fluorescent screen provided with green fluorescent stripes, blue fluorescent stripes and red fluorescent stripes repeats the electrodeposition process to form the green fluorescent stripes, the blue fluorescent stripes and the red fluorescent stripes over transparent electrode stripes. When the conventional electrodeposition process employing a solid transparent electrode for forming a monochromatic fluorescent screen is employed in forming a fluorescent screen, the electric field is concentrated on the edges of a pattern, portions of a fluorescent film covering the edge areas of the pattern are formed in a thickness greater than a portion of the same covering the central area of the pattern, the fluorescent film extends beyond the edges of the pattern and hence the fluorescent film cannot uniformly be formed on the screen panel. When the conventional electrodeposition process is applied to forming fluorescent stripes on transparent stripe electrodes, the electric field is concentrated on areas near the lower end, the left end and the right end of a pattern of the transparent stripe electrodes and, consequently, portions of the fluorescent films covering those areas are formed in a thickness greater than that of other portions covering other areas of the pattern, the fluorescent stripes extend beyond the edges of the stripe electrodes and hence the fluorescent stripes cannot uniformly be formed on the pattern of the transparent stripe electrodes. Furthermore, when either the transparent solid electrode or the stripe electrodes are coated with the fluorescent films by the electrodeposition process, the fluorescent material is attracted to an ineffective area, i.e., an area in which the fluorescent material need not be deposited, by nonelectro-static attraction, such as van der Waals force and, when electrons impinge on the ineffective or inactive area, the fluorescent materials coating the ineffective or inactive area are excited and become luminous to deteriorate the picture quality of the fluorescent screen.

SUMMARY OF THE INVENTION

Accordingly, it is an object of the present invention to provide a method of forming a fluorescent screen by forming fluorescent films on the inner surface of a screen panel for a field emission display by an electrodeposition process.

With the foregoing object in view, the present invention provides a method of forming a fluorescent screen for a field emission display by depositing particles of a fluorescent material or fluorescent materials on the inner surface of a screen panel by an electrodeposition process, comprising forming a transparent solid electrode or transparent stripe or dot electrodes in an effective area and a guard electrode in an ineffective or inactive area surrounding the effective area on the inner surface of a screen panel for a field emission display, applying a reverse bias voltage reverse to a voltage applied to the transparent solid electrode or transparent stripe or dot electrodes on which particles of a fluorescent material are to be deposited to the guard electrode, controlling the reverse bias voltage so that particles of the fluorescent material are deposited in a uniform thickness over the transparent solid electrode or the transparent stripe or dot electrodes formed in the effective area and particles of the fluorescent material will not be deposited on the guard electrode.

A method of forming a fluorescent film by an electrodeposition process in accordance with the present invention is applicable to forming a fluorescent film over patterns of transparent electrodes including a square or rectangular pattern of a transparent solid electrode, a pattern of a plurality of transparent stripe electrodes, and a pattern of transparent dot electrodes arranged in a given arrangement.

A method of forming a fluorescent film by an electrodeposition process in accordance with the present invention forms a transparent solid electrode of, for example, an ITO film, transparent stripe electrodes or transparent dot electrodes on the inner surface of a screen panel for a field emission display, forms a guard electrode on the inner surface of the screen panel so as to surround the effective area in which the transparent solid electrode, a pattern of the transparent stripe electrodes or a pattern of the transparent dot electrodes is formed, forms pillars for securing a vacuum, immerses the screen panel in an electrodeposition solution in which particles of a fluorescent material is dispersed, applies a negative (or positive) voltage to the transparent solid electrode, the pattern of transparent stripe electrodes or the pattern of transparent dot electrodes and applies a reverse bias voltage to the guard electrode for electrodeposition to deposit particles of the fluorescent material in a uniform thickness over the transparent solid electrode, the pattern of transparent stripe electrodes or the pattern of transparent dot electrodes. Since the reverse bias voltage is applied to the guard electrode covering the ineffective or inactive area on the screen panel, particles of the fluorescent material are not deposited in the ineffective area (over the guard electrode).

The size of the space between the periphery of the effective area, in which the transparent solid electrode, the pattern of transparent stripe electrodes or the pattern of transparent dot electrodes is formed, and the periphery of the ineffective area covered with the guard electrode is determined properly, and the reverse bias voltage applied to the guard electrode is controlled properly to control the deposition rate of the fluorescent material in the periphery of the effective area by controlling the electric field created in the vicinity of the periphery of the effective area. The reverse bias voltage applied to the guard electrode inhibits the electrophoresis of particles of the fluorescent material toward the guard electrode to prevent the deposition of the fluorescent material in the ineffective area. Thus, the deposition of the fluorescent material in the ineffective area can be prevented and the fluorescent material can be deposited in a uniform thickness in the effective area.

As is apparent from the foregoing description, the method of forming a fluorescent screen for a field emission display by electrodeposition in accordance with the present invention in which a reverse bias voltage is applied to the guard electrode has the following advantages.

1. A fluorescent film can be formed over the entire area of a pattern of a transparent solid electrode and the entire area of a pattern of transparent stripe electrodes in a uniform thickness in a pattern exactly and sharply conforming to the pattern of the transparent solid electrode and the pattern of transparent stripe electrodes.

2. The guard electrode prevents the deposition of particles of a fluorescent material in the ineffective area during electrodeposition.

3. The application of a reverse bias voltage during electrodeposition processes for forming color fluorescent stripes for a color fluorescent screen only to the transparent stripe electrodes other than those on which particles of a fluorescent material are to be deposited forms very uniform, sharp, pure color fluorescent stripes.

BRIEF DESCRIPTION OF THE DRAWINGS

The above and other objects, features and advantages of the present invention will become more apparent from the following description taken in connection with the accompanying drawings, in which.

DETAILED DESCRIPTION OF THE PREFERRED EMBODIMENTS

First Embodiment

Figure 1:
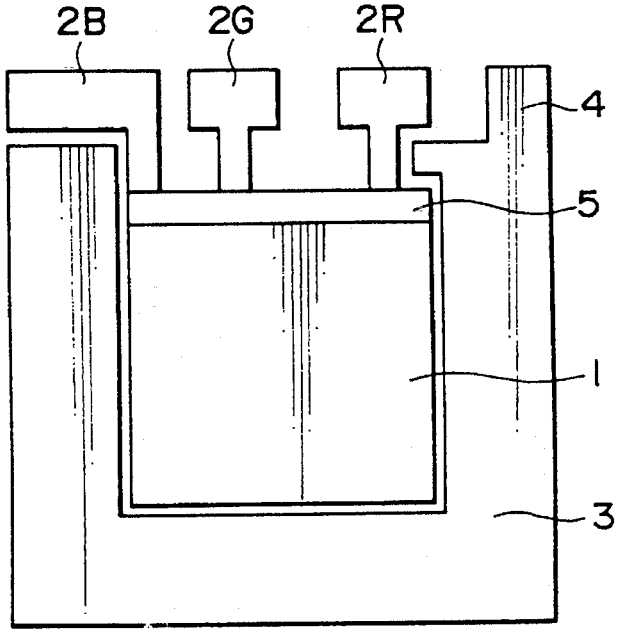
FIG. 1 is a plan view of a screen panel provided with transparent stripe electrodes and a guard electrode formed by a method of forming a fluorescent screen by electrodeposition, in a preferred embodiment according to the present invention.
Figure 4:
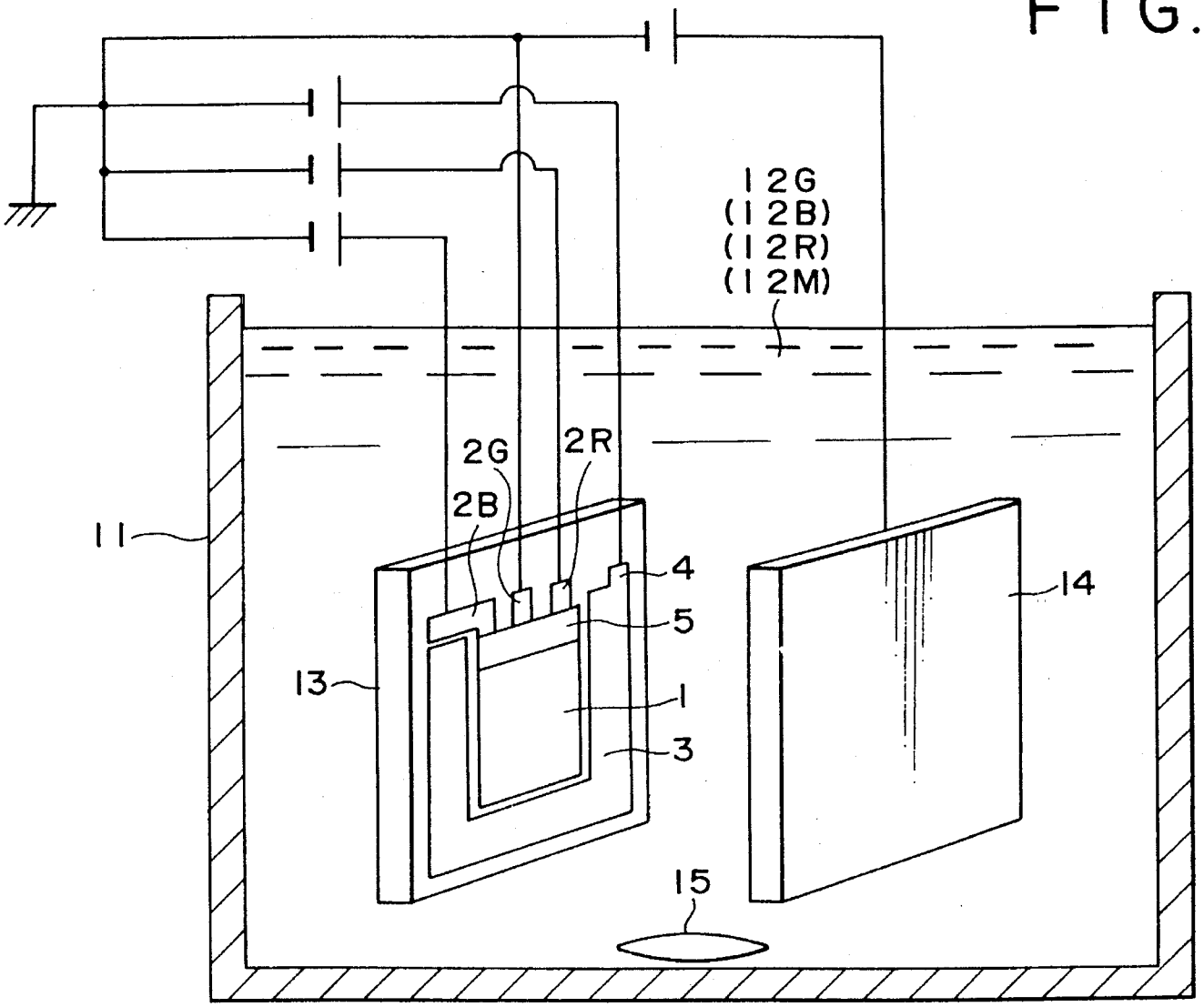
FIG. 4 is a schematic view of an electrodeposition apparatus for cathodic electrodeposition to be used for carrying out a method of forming a fluorescent screen by electrodeposition, in a preferred embodiment according to the present invention.

A method of forming a fluorescent screen by electrodeposition, in a first embodiment according to the present invention is an application of the present invention to forming a color fluorescent screen. Referring to FIG. 1, first a transparent conductive film of, for example, ITO is formed over the entire inner surface of a screen panel 13 (FIG. 4) for a field emission display. Then, a photoresist film is formed over the entire surface of the transparent conductive film. The photoresist film is subjected to patterning by a proximity exposure process or a contact exposure process using the previously prepared chromium pattern mask (include the specified stripe-like electrode pattern and guard electrode pattern) to form a latent image of the chromium pattern in the photoresist film, or by a laser beam exposure process or an electron beam exposure process, followed by development, etching and resist separation steps, thus forming a transparent electrode or the like.

As shown in FIG. 1, three terminals 2G, 2R and 2B are connected to the stripe electrodes 1 respectively for green fluorescent stripes, the stripe electrodes 1 for blue fluorescent stripes and the stripe electrodes 1 for red fluorescent stripes in a connecting area 5. The guard electrode 3 for preventing the deposition of fluorescent materials in an ineffective area is formed so as to surround the three sides of a stripe electrode area in which the stripe electrodes 1 are formed. A terminal 4 is connected to the guard electrode 3. The size of the spaces between the stripe electrode area and the guard electrode 3 is optional. In this embodiment, the width of each of the stripe electrodes 1 is 100 μm, intervals between the stripe electrodes 1 are 100 μm, intervals between trios each consisting of three stripe electrodes 1 respectively for one green fluorescent stripe, one blue fluorescent stripe and one red fluorescent stripe are 160 μm, and the width of the space between the inner side of the guard electrode 3 and the adjacent side of the stripe electrode area is 250 μm. The width of each of the stripe electrodes 1, the intervals between the stripe electrodes 1, intervals between trios and the width of the space between the guard electrode 3 and the stripe electrode area may be smaller than those values concretely specified above.

Figure 3:
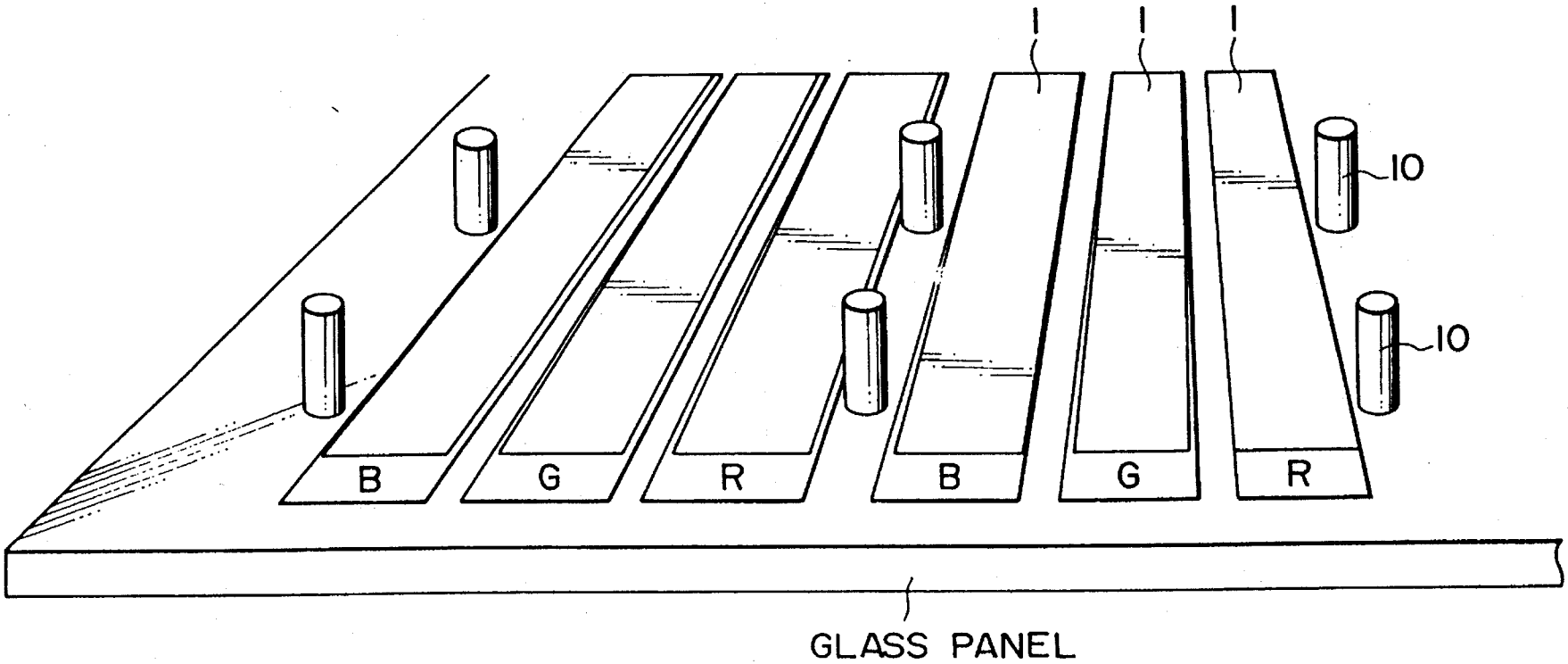
FIG. 3 is a schematic perspective view of a fluorescent screen provided with pillars for securing a vacuum, formed by a method of forming a fluorescent screen by electrodeposition, in a preferred embodiment according to the present invention.

Then, as shown in FIG. 3, pillars 10 for securing a vacuum are formed by a multilayer printing process or the like. Then, a green fluorescent material, a blue fluorescent material and a red fluorescent material are deposited sequentially on the corresponding electrode stripes 1 to form green fluorescent stripes, blue fluorescent stripes and red fluorescent stripes by, for example, cathodic electro-deposition. When forming the green fluorescent stripes, the screen panel 13 (FIG. 4) provided with the stripe electrodes 1, the guard electrode 3, the terminals 2G, 2B and 2R is immersed in an electrodeposition solution 12G containing dispersed particles of a green fluorescent material and contained in an electrodeposition tank 11. The electro-deposition solution contains 30 g green fluorescent particles, 1 to $3\times10^{-7}$ mol/l aluminum nitrate and lanthanum nitrate (electrolytes), 10 ml or less glycerol (dispersing agent), and 1000 ml isopropyl alcohol (solvent). Then, a negative voltage is applied through the terminal 2G to the transparent stripe electrodes 1 for the green fluorescent stripes, a positive voltage or a reference voltage i.e. 0 voltage is applied through the terminals 2B and 2R to the transparent stripe electrodes 1 for the blue fluorescent stripes and the red fluorescent stripes, a positive voltage is applied through the terminal 4 to the guard electrode 3, and a positive voltage is applied to a counter electrode 14 of platinum or the like, and the electrodeposition solution is stirred by a stirring device 15. Thus, green fluorescent stripes are formed in a uniform thickness over the transparent stripe electrodes 1 connected to the terminal 2G. Then, the screen panel 13 is washed with an alcohol or the like and the screen panel 13 is dried by hot-air drying. An optimum positive reverse bias voltage to be applied to the guard electrode 3 is dependent on both the composition of the electrodeposition solution and the space between the guard electrode 3 and the effective area in which the transparent stripe electrodes 1 are formed. However, the voltage to be applied to the guard electrode 3 is equal to or lower than the voltage difference between the transparent stripe electrodes 1 connected to the terminal 2G, and the counter electrode 14.

Then, blue fluorescent stripes are formed on the transparent stripe electrodes 1. The screen panel 13 is immersed in an electrodeposition solution 12B of a composition similar to that of the electrodeposition solution 12G for forming the green fluorescent stripes, containing dispersed particles of a blue fluorescent material, a negative voltage is applied through the terminal 2B to the transparent stripe electrodes 1 for blue fluorescent stripes, a positive voltage or a 0 voltage is applied through the terminals 2G and 2R to the transparent stripe electrodes 1 for green fluorescent stripes and red fluorescent stripes, a positive voltage is applied to the guard electrode 3, and a positive voltage is applied to the counter electrode 14 to form blue fluorescent stripes by electrodeposition on the transparent stripe electrodes 1 connected to the terminal 2B. Then, the screen panel 13 is washed with an alcohol or the like and the screen panel 13 is dried by hot-air drying.

Then, red fluorescent stripes are formed on the transparent stripe electrodes 1. The screen panel 13 is immersed in an electrodeposition solution 12R of a composition similar to that of the electrodeposition solution 12G for forming the green fluorescent stripes, containing dispersed particles of a red fluorescent material, a negative voltage is applied through the terminal 2R to the transparent stripe electrodes 1 for red fluorescent stripes fluorescent stripes, a positive voltage or a 0 voltage is applied through the terminals 2G and 2B to the transparent stripe electrodes 1 for green fluorescent stripes and blue fluorescent stripes, a positive voltage is applied to the guard electrode 3, and a positive voltage is applied to the counter electrode 14 to form red fluorescent stripes by electro-deposition on the transparent stripe electrodes 1 connected to the terminal 2R. Then, the screen panel 13 is washed with an alcohol or the like and the screen panel 13 is dried by hot-air drying.

In the cathodic electrodeposition process, hydrogen ions are produced at the cathode by the electrolysis of water and the electrochemical actions of ions of the electrolytic substances, and the hydrogen ions reduce the ITO films. The reduction of the ITO films by the hydrogen ions can be avoided by removing water, removing free ions of the electrolytic substances by electrolytic processing and changing the supernatant liquid of the electrodeposition solution. The thickness of the fluorescent film is dependent on the duration of the electrodeposition process, the intensity of the electric field, and the fluorescent material content of the electrodeposition solution. For example, when the intensity of the dc electric field is 7.5 V per 40 mm, a fluorescent film of 15 μm in thickness can be formed in 60 to 120 sec. Washing time in which the screen panel 13 is washed with an alcohol or the like is about 30 sec.

Most fluorescent materials excluding those easily dissolvable in the solvent may be used. For example, the green fluorescent material is ZnS:Cu, Al, the blue fluorescent material is ZnS:Ag, Cl, and the red fluorescent material is $Y_2O_2S$:Eu, CdS.

Second Embodiment

A method of forming a fluorescent screen by electrodeposition, in a second embodiment according to the present invention is an application of the present invention to forming a monochromatic fluorescent screen.

Figure 2:
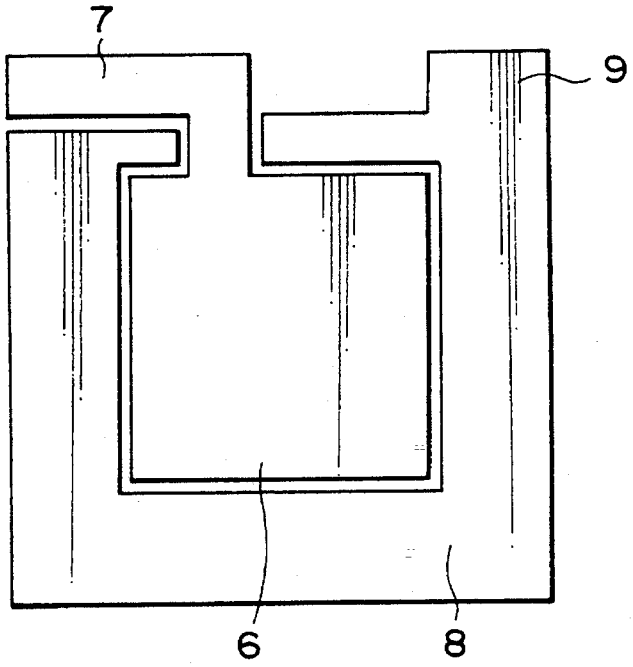
FIG. 2 is a plan view of a screen panel provided with a transparent solid electrode and a guard electrode formed by a method of forming a fluorescent screen by electrodeposition, in a preferred embodiment according to the present invention.

Referring to FIG. 2, a transparent solid electrode 6 of ITO and a guard electrode 8 are formed on the inner surface of a screen panel 13 by a process similar to that employed in the first embodiment. The transparent solid electrode 6 is connected to a terminal 7, and the guard electrode 8 is connected to a terminal 9. The size of the space between the transparent solid electrode 6 and the guard electrode 8 is optional.

The screen panel 13 provided with the electrodes 6 and 8, and the terminals 7 and 9 is immersed in an electrodeposition solution 12M of a composition similar to that of the electrodeposition solution used in carrying out the first embodiment, containing dispersed particles of a monochromatic fluorescent material and contained in an electrodeposition tank 11. A dc negative voltage is applied through the terminal 7 to the transparent solid electrode 6, a positive voltage is applied through the terminal 9 to the guard electrode 8, and a positive voltage is applied to the counter electrode to deposit the particles of the monochromatic fluorescent material in a monochromatic fluorescent film of a uniform thickness over the transparent solid electrode 6, i.e., an effective area, in which particles of the monochromatic fluorescent material will not be deposited over the guard electrode 8, i.e., an ineffective area. Although an optimum positive voltage to be applied to the guard electrode 8 for forming a monochromatic fluorescent film of a uniform thickness and for preventing the deposition of particles of the monochromatic fluorescent material in the ineffective area is dependent on the composition of the electrodeposition solution and the space between the transparent solid electrode 6 and the guard electrode 8, i.e., the space between the effective area and the ineffective area, a voltage to be applied to the guard electrode 8 is equal to or lower than the voltage difference between the transparent solid electrode 6 and the counter electrode. After the solid monochromatic fluorescent film has thus been formed over the transparent solid electrode 6, the screen panel 13 is washed with an alcohol or the like and the screen panel 13 is dried by hot-air drying.

The thickness of the monochromatic fluorescent film is dependent on the duration of the electrodeposition process, the intensity of the electric field and the monochromatic fluorescent material content of the electrodeposition solution. For example, when the intensity of the dc electric field is 15 V per 40 mm, a monochromatic fluorescent film of 15 μm in thickness can be formed in four to five minutes. The screen panel 13 can be washed with an alcohol or the line in about 30 sec. When the monochromatic fluorescent film is formed by anodic electrodeposition by using an electrodeposition solution of a ketone system containing nitrocellulose, the effect of application of a reverse bias voltage to the guard electrode 8 is the same as that of application of a reverse bias voltage to the guard electrode 8 in the cathodic electrodeposition. Most fluorescent materials including ZnO:Zn excluding those easily dissolvable in solvents can be used for forming the monochromatic solid fluorescent film.

Although the invention has been described in its preferred form with a certain degree of particularity, obviously many changes and variations are possible therein. It is therefore to be understood that the present invention may be practiced otherwise than as specifically described herein without departing from the scope and spirit thereof.

What is claimed is:

1. A method of forming a fluorescent screen for a field emission display by depositing particles of a fluorescent material on the inner surface of a screen panel by an electrodeposition process, said method comprising:

forming a transparent solid electrode in an effective area, and a guard electrode in an ineffective area surrounding the effective area on the inner surface of a screen panel for a field emission display; and an electrodeposition process for forming a solid fluorescent film, comprising steps of:

immersing the screen panel provided with the transparent solid electrode and the guard electrode in an electrodeposition solution containing dispersed particles of a fluorescent material, applying a voltage to the transparent solid electrode and a reverse bias voltage of a polarity reverse to that of the voltage applied to the transparent solid electrode to the guard electrode, controlling the reverse bias voltage so that particles of the fluorescent material will not be deposited on the guard electrode, and washing and drying the screen panel after the solid fluorescent film has been formed.

2. A method of forming a fluorescent screen for a field emission display according to claim 1, wherein the reverse bias voltage is not higher than the voltage difference between the transparent solid electrode and a counter electrode in said solution.

3. A method of forming a fluorescent screen for a field emission display by depositing particles of fluorescent materials on the inner surface of a screen panel by electrodeposition processes, said method comprising:

forming transparent stripe or dot electrodes in an effective area, and a guard electrode in an ineffective area surrounding the effective area on the inner surface of a screen panel for a color field emission display, said electrodes in the effective area being divided into a first group, a second group and a third group;

a first electrodeposition process for forming fluorescent stripes or dots for a first color on said first group, comprising the steps of:

immersing the screen panel provided with the transparent stripe or dot electrodes and the guard electrode in an electrodeposition solution containing dispersed particles of a first fluorescent material, applying a voltage to the first group of the transparent stripe or dot electrodes on which particles of the first fluorescent material are to be deposited, a reference voltage to the second and third groups and a reverse bias voltage of a polarity reverse to that of the voltage applied to the first group of the transparent stripe or dot electrodes to the guard electrode, controlling the reverse bias voltage so that particles of the first fluorescent material will be deposited to a uniform thickness on the first group and will not be deposited on the guard electrode, and washing and drying the screen panel after the fluorescent stripes or dots for the first color have been formed;

a second electrodeposition process for forming fluorescent stripes or dots for a second color on the second group, comprising the steps of:

immersing the screen panel in an electrodeposition solution containing dispersed particles of a second fluorescent material, applying a voltage to the second group of the transparent stripe or dot electrodes on which particles of the second fluorescent material are to be deposited, a reference voltage to the first and third groups and a reverse bias voltage to the guard electrode, controlling the reverse bias voltage so that particles of the second fluorescent material will be deposited to a uniform thickness on the second group and will not be deposited on the guard electrode, and washing and drying the screen panel after the fluorescent stripes or dots for the second color have been formed; and a third electrodeposition process for forming fluorescent stripes or dots for a third color on the third group, comprising the steps of:

immersing the screen panel in an electrodeposition solution containing dispersed particles of a third fluorescent material, applying a voltage to the third group of the transparent stripe or dot electrodes on which particles of the third fluorescent material are to be deposited, a reference voltage to the first and second groups and a reverse bias voltage to the guard electrode, controlling the reverse bias voltage so that particles of the third fluorescent material will be deposited to a uniform thickness on the third group and will not be deposited on the guard electrode, and washing and drying the screen panel after the fluorescent stripes or dots for the third color have been formed.

4. A method of forming a fluorescent screen for a field emission display according to claim 3, wherein the reverse bias voltage is not higher than the voltage difference between the transparent stripe or dot electrodes on which particles of one of the fluorescent materials are to be deposited and a counter electrode.

5. A method according to claim 1, wherein the step of controlling the reverse bias voltage obtains a uniform deposit of the film without any built-up thickness at any edges of the solid electrodes.

* * * * *